United States Patent [19]

Baun

[11] Patent Number: 4,733,697

[45] Date of Patent: Mar. 29, 1988

[54] PILOT OPERATED COOLANT CONTROL VALVES IN MANIFOLD ASSEMBLY

[76] Inventor: Daniel Baun, 696 McClurg Rd., Youngstown, Ohio 44512

[21] Appl. No.: 95,008

[22] Filed: Sep. 10, 1987

[51] Int. Cl.[4] ..... B05B 1/14

[52] U.S. Cl. ..... 137/884; 137/883; 137/340; 251/30.02; 239/551

[58] Field of Search ..... 137/883, 884, 340; 239/551; 251/30.01, 30.02

[56] References Cited

U.S. PATENT DOCUMENTS

| | | | |
|---|---|---|---|
| 3,145,767 | 8/1964 | Gardner | 251/5 |
| 3,159,374 | 12/1964 | Kroffke | 251/30 |
| 3,903,919 | 9/1975 | Zevner | 251/44 |
| 3,905,575 | 9/1975 | Zevner et al. | 251/44 |
| 4,305,566 | 12/1981 | Grawurde | 251/30.02 |
| 4,387,739 | 6/1983 | Schaming | 137/884 |
| 4,391,296 | 7/1983 | Abbott | 137/523 |
| 4,568,026 | 2/1986 | Baun | 239/551 |

*Primary Examiner*—A. Michael Chambers
*Attorney, Agent, or Firm*—Harpman & Harpman

[57] ABSTRACT

A plurality of pilot valve controlled coolant control valves are mounted in manifolds which in turn are positioned adjacent the work and backup rolls of a rolling mill and used to supply coolant to said rolls in desirable spray patterns covering the surfaces of the rolls. The control valves are operable by fluid pressure of the coolant so as to fail-safe in open position to continue delivering coolant to the rolls to protect the same during an unscheduled interruption.

5 Claims, 5 Drawing Figures

PILOT OPERATED COOLANT CONTROL VALVES IN MANIFOLD ASSEMBLY

BACKGROUND OF THE INVENTION

1. Technical Field

This invention relates to rolling mills in general and more particularly to rolling mills where steel is being reduced to thin gauge sheets and strips and still more particularly to coolant applying devices for said rolling mills.

2. Description of the Prior Art

Prior coolant applying devices used on rolling mills have arranged elongated manifolds parallel with the work and backup rolls of the rolling mill and directed fluids, such as water, through individual spray nozzles on the manifolds against the rolls of the mill to provide termperature control and lubrication during an actual rolling operation.

Several prior art patents relate to pilot operated control valves including U.S. Pat. Nos. 3,145,967, 3,159,374, and 4,391,296. In each of these patents solenoid operated valves are disclosed with theoretically control fluid directed therethrough. In U.S. Pat. No. 3,145,967 an elastic sleeve is arranged in spaced relation about a core positioned in a fluid passageway to be controlled. An annular cavity in the valve around the exterior surface of the elastic sleeve enables air pressure to be introduced so as to distort the plastic sleeve inwardly against the core and thus close the fluid passageway. The air pressure is controlled by a solenoid operated valve.

In U.S. Pat. No. 3,159,374 a flexible diaphragm is positioned to intercept a fluid passageway through the valve when fluid pressure is applied to one side of the diaphragm so as to distort the same into closing relation to the fluid passageway controlled thereby. The fluid pressure for operating the diaphragm is controlled by a solenoid valve.

U.S. Pat. No. 4,391,296 discloses a valve in which a valve plug moves into and out of closing relation with respect to a fluid passageway extending between an inlet port and an outlet port with the valve plug being urged to closed position in the fluid passageway by a spring and moved to open position by a solenoid. A piston is positioned in an extension of the fluid passageway and a secondary inlet port is in communication with the fluid passageway below the piston so that manual operation of the valve can be achieved by introducing hydraulic pressure into the second inlet port so as to move the piston in the fluid passageway where it will engage and open the valve plug.

Applicant's U.S. Pat. No. 4,568,026 discloses as assembly of pilot operated coolant control valves in which the individual valves are arranged in cartridges and in which solenoid actuated pilot valves must remain energized to afford continuous coolant flow. The control valves of the present invention are dependent upon fluid pressure of the coolant supply in the manifold assembly. These valves must remain open despite any power failure that occurs and continue spraying the coolant liquid as long as the rolling mill is operating to protect the rolls against distortion and such other damage as will occur if the coolant is discontinued. The prior art pilot operated control valves are unable to maintain a fail-safe open condition upon a failure of the solenoid actuating circuits or faulty operation due to dirt or particles of foreign materials in the coolant supply. Generally the prior art coolant valves require complete dismantling of the valve bodies and the operable parts whereas in the present invention the valve bodies defining the valve seats and the movable valve elements take the form of quickly and easily removable cartridges and due to their novel construction and operating patterns are able to operate successsfully and remain open while the rolling mill is operating despite any failure in the pilot valves or their control medium.

This invention eliminates many of the problems that heretofore existed in connection with pilot operated coolant control valves arranged in and supplied by manifold assemblies.

SUMMARY OF THE INVENTION

A pilot operated coolant control valve assembly in a coolant supply manifold provides a plurality of fail-safe valve elements in removable cartridge-like assemblies controlling the supply of coolant, such as water, to individual spray nozzles directed at steel rolling mill rolls and the like, each of the multiple coolant control valves is operable to a closed position by solenoids incorporated therein and operable to open position by de-energization of the solenoids and the hydraulic actuation of the coolant control valve elements by the pressure of the coolant.

DESCRIPTION OF THE PREFERRED EMBODIMENT

Figure 1:
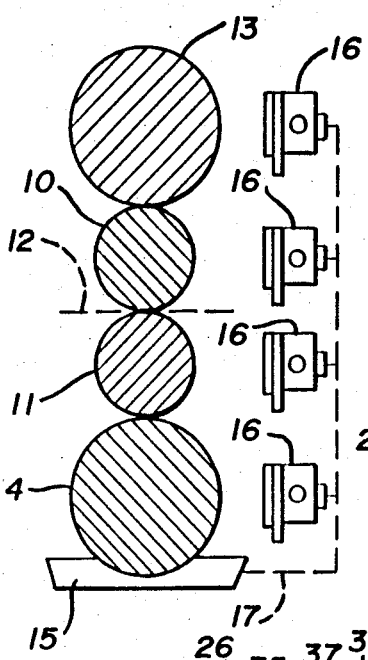
FIG. 1 is a symbolic illustration of a pair of work rolls and associated backup rolls of a rolling mill with a fluid collecting trough therebelow and several fluid spraying manifold assemblies therebeside.

By referring to FIG. 1 of the drawings, it will be seen that a diagrammatic illustration of a rolling mill discloses superimposed work rolls 10 and 11 engaged on a pass line 12 and having backup rolls 13 and 14 as will be understood by those skilled in the art. Such rolling mills are used in reducing steel billets to continuous hot rolled strip and/or sheet. Means for driving the rolls is not illustrated. A coolant collection trough 15 is shown and four vertically spaced coolant control valve manifold assemblies 16 are shown positioned in spaced relation to the work rolls 10 and 11 and the backup rolls 13 and 14. Means for circulating a coolant fluid such as water from a collecting trough 15 to the manifold assembly 16 is indicated by broken lines 17.

Figure 2:
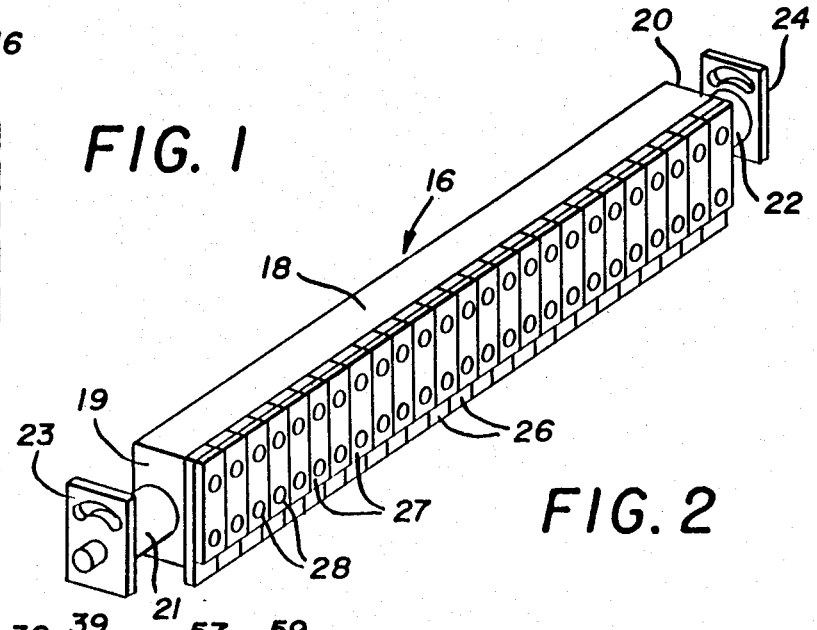
FIG. 2 is a perspective elevation of a plurality of coolant control valves in a manifold assembly.

By referring to FIG. 2 of the drawings, a perspective elevation of one of the coolant control valve manifold assemblies 16 may be seen and it is formed of an elongated housing 18 closed at its ends 19 and 20 and provided with end extensions 21 and 22 including mounting and adjustment plates 23 and 24 by which the housing 18 is supported adjacent a roll of a rolling mill as hereinbefore described in connection with FIG. 1 of the drawings.

Figure 3:
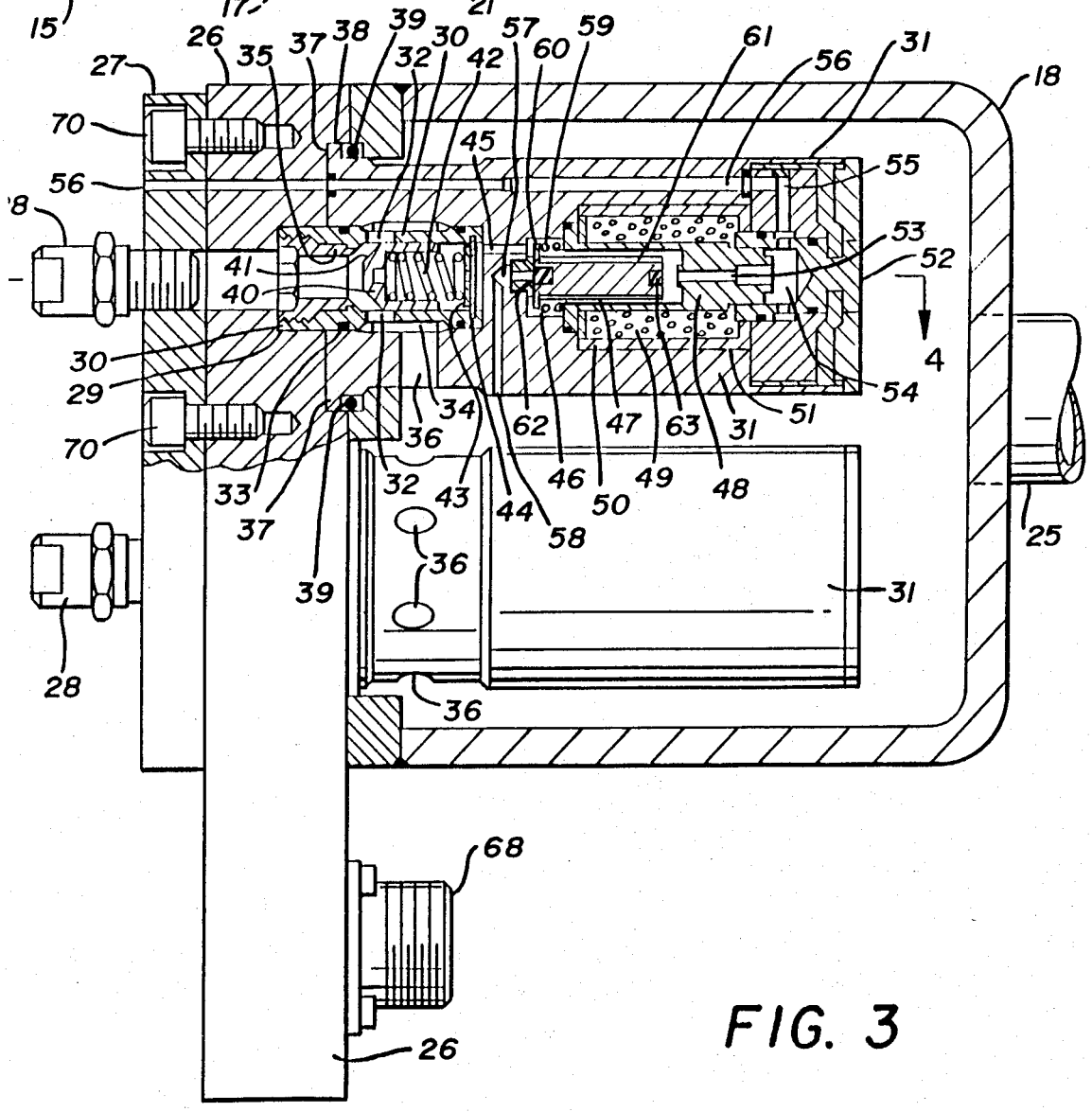
FIG. 3 is a cross sectional elevation transversely of one of the control valves in the manifold assembly of FIG. 2 with parts broken away and parts in cross section.

Inlet ports 25, see FIG. 3, comprise means for delivering a liquid coolant such as water thereinto and a plurality of body members 26 are sealingly attached to an open side of the housing 18 and carry nozzle plates 27, each of which carries one or more spray nozzles 28 through which the coolant is selectively directed to the rolls of the rolling mill in desirable volume and spray patterns.

A vertical section through one of the elongated housings 18 and one of the pilot operated coolant control valve assemblies secured thereto is seen in FIG. 3 of the drawings.

By referring now to FIG. 3 of the drawings, it will be seen that each of the plurality of pilot operated coolant valves is mounted in apertures 29 in each of the body members 26 and that each of the coolant control valves comprises a cylindrical valve body 30 having openings 32 circumferentially spaced therein. Several annular seals such as O-rings 33 are carried in annular grooves in the cylindrical valve body 30 which sealingly engage apertures in a cartridge body 31 on either side of a cross sectionally circular cavity 34 therein. A removable member in the valve body 30 forms a valve seat 35.

By referring to FIG. 3 in particular, it will be seen that each of the cartridge bodies 31 has several openings 36 therein which communicate with the cross sectionally circular cavity 34 therein and each of the bodies 31 is provided with an annular flange 37 on one end which registers in an annular cavity 38 in the body member 26. Annular seals such as O-rings 39 are positioned between the annular flanges 37 of the cartridge bodies 31 and the side of the elongated housing 18.

Figure 4:
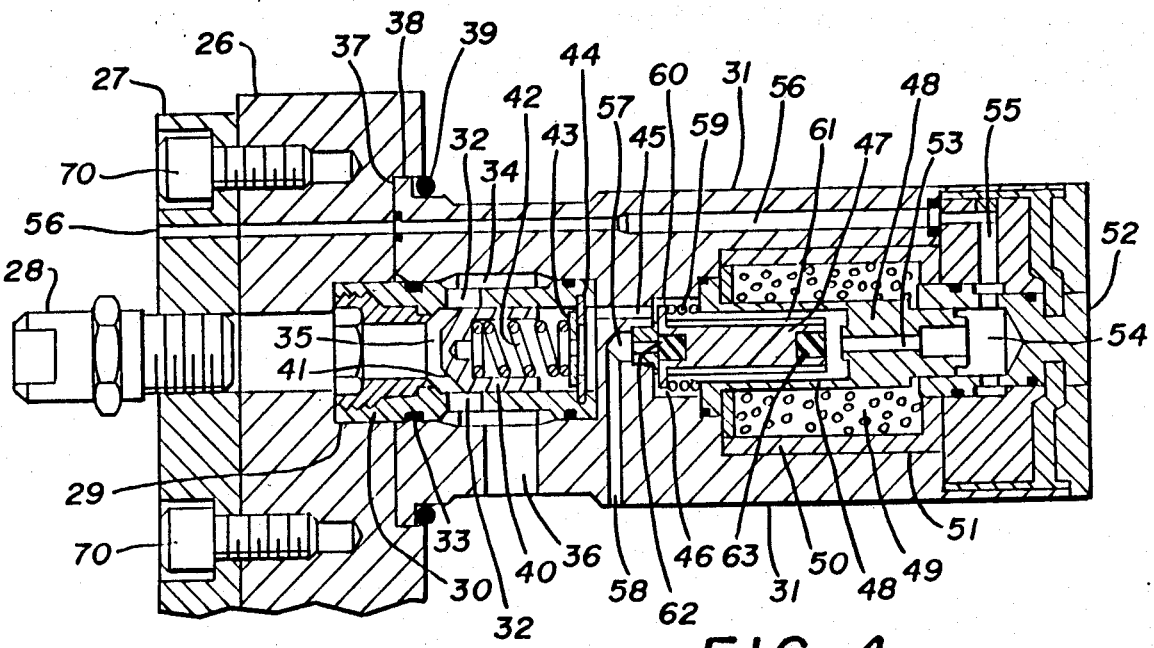
FIG. 4 is a side elevation of one of the coolant valve assemblies and operating solenoids of FIG. 3 with parts broken away and parts in cross section.

Referring to FIGS. 3 and 4 of the drawings, it will be seen that a cylindrical valve element 40 having a closed conical end 41 is movably positioned in the cylindrical valve body 30 so as to be movable therein relative to the openings 32 and the area of reduced diameter of the valve seat 35 therein. It will also be seen that the inner diameter of the cylindrical valve body 30 is increased in the area thereof in which the cylindrical valve element 40 is slidably mounted and that the closed conical end 41 of the valve element 40 will engage the conical valve seat 35 when the valve element 40 is moved to the left. A spring 42 is positioned within the valve element 40 and engaged against the inner surface of the closed end 41 thereof and against a centrally apertured disc 43 which is secured in one end of the cylindrical valve body 30 by a snap ring 44.

By referring to FIGS. 3 and 4 of the drawings, it will be observed that a passageway 45 establishes communication between the inner end of the cavity 34 in the cartridge body 31 and a pilot valve chamber 46 therein. A longitudinally slotted solenoid plunger 47 is movably disposed in a sleeve 48 which defines a part of the pilot valve chamber 46 and which sleeve 48 is positioned within a solenoid coil 49 which is encapsulated by a suitable resin 40 which holds the solenoid coil 49 in an enlarged cavity 51 in the cartridge body 31. The sleeve 48 engages a multiple part closure 52 positioned in one end of the cartridge body 31. A passageway 53 in the sleeve 48 communicates with a cavity 54 in the closure 52 and a passageway 55 which communicates with a passageway 56 extending through the cartridge body 31, the body member 26 and the nozzle plate 27 to atmosphere.

Still referring to FIGS. 3 and 4 of the drawings, it will be seen that the plunger 47 has secondary valve elements comprising resilient seals in each of its opposite ends, one of which will engage and close the passageway 53 when the plunger 47 moves to the right responsive to energization of the solenoid coil 49. The seal in the opposite end of the plunger 47 engages an opening in a pilot valve seat 57 when the solenoid coil 49 is de-energized. The opening in the pilot valve seat 57 communicates by way of a passageway 58 with the coolant in the housing 18 which is pressurized.

A spring 59 is positioned between an annular flange 60 on the slotted plunger 47 and an end of the sleeve 48 and urges the plunger 47 toward the opening in the pilot valve seat 57. It will be observed that the plunger 47 and the end portion thereof including the annular flange 60 has a longitudinally extending slot 61 in the outer surface thereof and that as illustrated in FIGS. 3 and 4 of the drawings, the secondary valve element comprising a resilient seal 62 in the end of the plunger 47 adjacent the annular flange 60 closes the opening in the pilot valve seat 57 when the solenoid coil 49 of the device is de-energized, the secondary valve element comprising the resilient seal 63 in the opposite end of the plunger 47 being spaced with respect to the passageway 53. When this occurs, the fluid pressure of the coolant in the housing 18 of the manifold communicates with the cross sectionally circular cavity 34 in the cartridge body 31 by way of the several circumferentially spaced openings 36 and by way of the openings 32 in the cylindrical valve body 30, the fluid pressure engages the outer surface of the closed conical end 41 of the valve element 40 so as to move the same away from the valve seat 35 overcoming the resistance of the spring 42 in the valve element 40 which opens the main fluid control valve and permits the coolant in the elongated housing 18 to flow through the valve seat 35 and outwardly through the spray nozzles 28 thereby insuring the continuous delivery of the coolant to the work rolls 10 and 11 and the backup rolls 13 and 14 which are thereby insured against distortion or damage which would otherwise occur as a result of the increased temperature thereof from the rolling of the hot steel.

Figure 5:
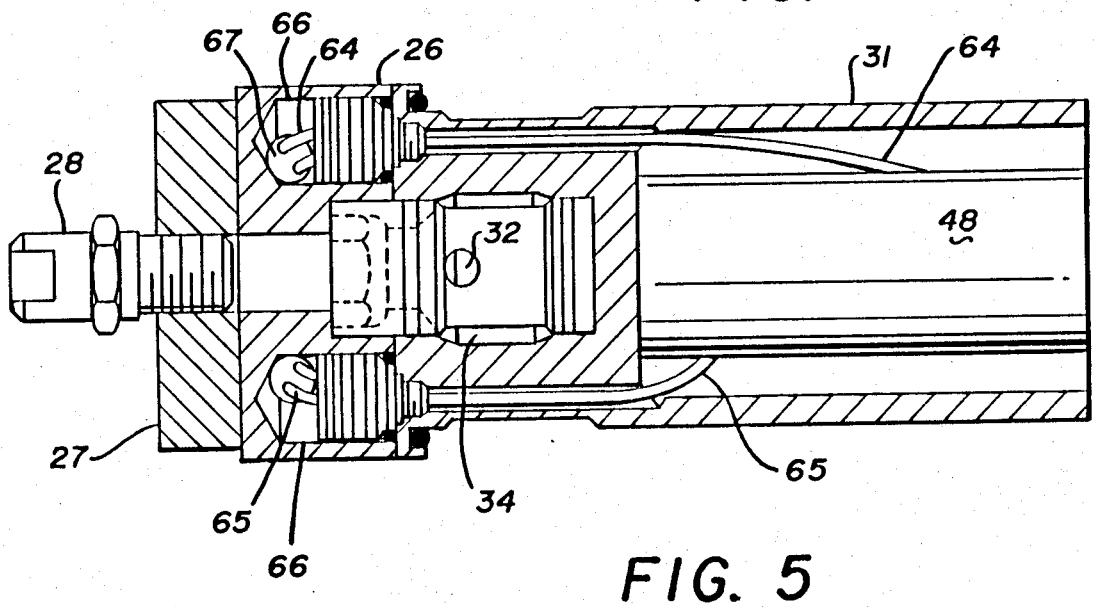
FIG. 5 is a side elevation of one of the coolant valves of FIG. 3 with parts broken away and parts in cross section and illustrating the wiring for operating the solenoid pilot valve thereof.

At such time as the rolls 10, 11, 13 and 14 have cooled, the solenoid coils 49 are energized by electrical circuits, some of which are illustrated in FIG. 5 of the drawings, wherein conductors 64 and 65 are illustrated extending from the solenoid coil 49 in the sleeve 48 to separable connections in apertures 66 in the body member 26. Vertical chambers 67 in the body member 26 provide conduits for the electrical conductors 64 and 65 and in FIG. 3 of the drawings, a connecting fitting 68 on the outer lower surface of the body member 26 comprises the means of connecting the conductors 64 and 65 with a wiring harness, not shown, leading to a suitable power source and control switches, not shown. When the flow of coolant through the nozzles 28 is no longer needed, the solenoid coils 49 are energized causing the longitudinally slotted plunger 47 to move to the right where the resilient seal 63 in the right end thereof engages and closes the passageway 53 in the sleeve 48. At the same time, the resilient seal 62 in the other end of the plunger 47 moves away from the opening 57 in the pilot valve seat whereupon fluid pressure of the coolant in the housing 18 extends through the passageway 58, the opening 57 in the pilot valve seat and into the pilot valve chamber 46 and through the passageway 45 into the cavity 34 by way of the apertured disc 43. The fluid pressure thus delivered into the cavity 43 which is of a greater area than the valve seat 35 immediately moves the valve element 40 and its closed conical end 41 into sealing engagement with the conical valve seat 35 and thus stops the flow of coolant through the device as the combined fluid pressure of the coolant and the tension of the spring 42 overcome the pressure of the coolant which has been maintaining the valve element in open position as hereinbefore described.

It will thus be seen that the coolant fluid, such as water, is readily controlled with respect to shutting off the flow of coolant to the spray nozzles 28 from whence it is delivered to the rolls of the rolling mill and it will also be observed that the arrangement is such that de-energization of the solenoid coils 49 immediately results in the delivery of the coolant through the spray nozzles 28 to the rolls of the rolling mill when this is required and that the opening of the control valves 40 is accomplished by the fluid pressure of the coolant as the same enters the passageways 36 and the cavities 34 and the openings 32 in the control valve body 30 where it moves the valve element 40 away from the valve seat 35 and flows outwardly through the spray nozzles 28. This action is expedited by the establishment of a vent to atmosphere from the chamber 34 around the control valve body 30 and opposite the closed conical end 41 of the valve element 40 by way of the apertured disc 43, the passageway 45, the pilot valve chamber 46, the slot 61 in the plunger 47 and the passageways 53, 54, 55 and 56 respectively, which communicates with the atmosphere. The arrangement thus vents fluid in the interior of the cylindrical valve body 30 and the interior of the valve element 40 to atmosphere to hasten the movement of the valve element 40.

The body members of the device of the invention are preferably stainless steel and as hereinbefore described it will be recognized that the actual coolant controlling valves are formed as readily replaceable poppet cartridges which can be readily removed and inspected and/or replaced if necessary by simply removing the nozzle plate 27 which is attached to the body member 26 by fasteners 70. The cartridge bodies 31 are similarly attached to the body member 26 by similar fasteners, not shown. The solenoid coils 49 being sealed and held in place by encapsulation in epoxy resin are protected from damage which might otherwise occur from the coolant in which the cartridge bodies are submerged. The solenoid coils 49 are designed to operate at 24 volts DC and draw a maximum of 0.88 amps. The plungers 47 and the solenoid coils 49 are so designed that the same are fully operational at 85% of the indicated voltage and thus evidence small power requirements which substantially improve the invention, both with respect to automatic and manual input signals for operation.

Those skilled in the art of rolling mill reduction of steel, both hot and cold rolled, will be familiar with the fact that the continuous direction of a suitable coolant, such as water, as specified herein on the work and backup rolls of the rolling mills controls the temperature of the work rolls and thereby insures the maintenance of a desirable gauge of the metal being rolled. A desired coolant temperature easily maintained with the present system is between 90° F. and 160° F. with coolant pressure supplied the plurality of spray nozzles 28 at varying desirable pressures such as 150 P.S.I. The nozzles 28 are preferably arranged for indexing at 15° from a transverse center line so as to insure complete coverage of the work and backup rolls of the rolling mill on which the device is used. A typical pilot operated coolant valve assembly for a hot rolling mill as disclosed herein will operate successfully for several million cycles and consistently avoid leakage when in closed or non-operating status and more importantly insure continuous delivery of coolant to the work and backup rolls as desired.

It will thus be seen that substantially improved pilot operated coolant control valves in manifold assembly have been disclosed and although but one embodiment of the present invention has been illustration and described, it will be apparent to those skilled in the art that various changes and modifications may be made therein without departing from the spirit of the invention or from the scope of the appended claims.

Having thus described my invention what I claim is:

1. In pilot operated coolant control valves in a manifold assembly for supplying a coolant to a rolling mill and having apertured body members closing said manifold wherein said coolant control valves are formed as removable cartridges positioned in registry with said apertures in said body members; the improvement wherein each of said removable cartridges consists of a cartridge body having a cavity therein communicating with one end thereof, a cylindrical valve body in said cavity, a valve seat in said cylindrical valve body, a valve element movably disposed in said cylindrical valve body, spring means urging said valve element toward said valve seat, openings in said cylindrical valve body adjacent said valve seat for receiving coolant from said manifold by way of openings in said cartridge body so as to urge said valve element away from said valve seat, a pilot valve chamber in said cartridge body adjacent said cavity and a passageway establishing communication between said cavity and said pilot valve chamber and between said pilot valve chamber and the exterior of said cartridge body and said manifold, a secondary valve seat in said passageway, a solenoid coil in said cartridge body, a solenoid plunger in said solenoid coil and a valve element on said solenoid plunger movable toward and away from said secondary valve seat, a longitudinally extending groove in a surface of said solenoid plunger forming a part of said passageway, said solenoid coil arranged to move said said solenoid plunger and valve element away from said secondary valve seat when energized so as to open said passageway, spring means positioned between said solenoid coil and said solenoid plunger urging said plunger toward said secondary valve seat so as to close said passageway when said solenoid coil is de-energized whereby fluid pressure in said manifold moves said valve element away from said valve seat to establish communication for said coolant through said cavity, the cylindrical valve body, and said valve seat to a spray nozzle downstream with respect thereto.

2. The improvement in pilot operated coolant control valves in a manifold assembly of claim 1 wherein a secondary passageway establishes communication between said pilot valve chamber and the exterior of said cartridge body and the coolant in said manifold wherein a third valve seat is positioned in said secondary passageway and a secondary valve element on said solenoid plunger is arranged to close said third valve seat in said secondary passageway when said first valve element on said solenoid plunger moves away from said secondary valve seat.

3. The improvement in pilot operated coolant control valves in a manifold of claim 1 wherein said passageway establishing communication between said pilot valve chamber and the exterior of said cartridge body and said manifold comprises a first portion in a sleeve in said solenoid coil in which said solenoid plunger is positioned, a slot in the surface of said solenoid plunger and a cavity in a multiple part closure in one end of said cartridge body, a second portion of said passageway being formed in said multiple part closure in communication with said cavity therein and a third portion of said passageway extending from said second portion through said cartridge body and said body members to atmosphere.

4. The improvement in pilot operated coolant control valves in a manifold assembly of claim 1 and wherein said cylindrical valve body in said cavity extends into a matching cavity in one of said apertured body members and wherein one of said apertured body members comprises a nozzle plate and said nozzle is engaged in an aperture in said nozzle plate.

5. The improvement in pilot operated coolant control valves in a manifold assembly of claim 1 and wherein the electrical conductors in connection with said solenoid coils extend through passageways in said cartridge bodies and wherein secondary electrical conductors are positioned in vertically extending chambers formed in one of said apertured body members and means removably connects said electrical conductors with said secondary electrical conductors and wherein epoxy resin encapsulates said solenoid coils and electrical conductors.

* * * * *